US005613836A

United States Patent [19]

Takenaka et al.

[11] Patent Number: 5,613,836

[45] Date of Patent: Mar. 25, 1997

[54] FLOW RESTRICTING STRUCTURE OF COMMUNICATING PASSAGES BETWEEN CHAMBERS OF A RECIPROCATING TYPE COMPRESSOR

[75] Inventors: Kenji Takenaka; Kazushige Murao, both of Kariya, Japan

[73] Assignee: Kabushiki Kaisha Toyoda Jidoshokki Seisakusho, Kariya, Japan

[21] Appl. No.: 527,544

[22] Filed: Sep. 13, 1995

[30] Foreign Application Priority Data

Sep. 16, 1994 [JP] Japan ..... 6-222013

[51] Int. Cl.[6] ..... F04B 1/26

[52] U.S. Cl. ..... 417/222.2

[58] Field of Search ..... 417/222.2, 269, 417/270; 91/499, 502, 505

[56] References Cited

U.S. PATENT DOCUMENTS

| | | | |
|---|---|---|---|
| 4,688,997 | 8/1987 | Suzuki et al. | 417/222.2 |
| 4,747,754 | 5/1988 | Fujii et al. | 417/222.2 |
| 4,867,649 | 9/1989 | Kawashima et al. | 417/222.2 |
| 4,913,626 | 4/1990 | Terauchi | 417/222.2 |
| 5,071,321 | 12/1991 | Skinner et al. | 417/222.2 |
| 5,332,365 | 7/1994 | Taguchi | 417/222.2 |
| 5,380,161 | 1/1995 | Takenaka et al. | 417/222.2 |

*Primary Examiner*—Timothy Thorpe
*Assistant Examiner*—Peter G. Korytnyk
*Attorney, Agent, or Firm*—Brooks Haidt Haffner & Delahunty

[57] ABSTRACT

A piston reciprocating type compressor has a passage structure for connecting a crank chamber to a discharge chamber and/or a suction chamber. A gas bleeding passage connects the crank chamber to the suction chamber. The gas compressed by the piston in the cylinder bore is leaked to the crank chamber causing the pressure raise in the crank chamber. The bleeding passage release the excessive pressure in the crank chamber to the suction chamber. The bleeding passage is partially deformed by a notch formed in a gasket. The notch has a smaller sectional area than the rest of the bleeding passage, regulating the pressure transmitted from the crank chamber to the suction chamber.

13 Claims, 9 Drawing Sheets

FLOW RESTRICTING STRUCTURE OF COMMUNICATING PASSAGES BETWEEN CHAMBERS OF A RECIPROCATING TYPE COMPRESSOR

BACKGROUND OF THE INVENTION

1. Field of the Invention

The present invention relates to a reciprocating type compressor. More particularly, it pertains to a flow restricting structure in pressure passages between chambers in a reciprocating type compressor, which employs a drive plate to compress refrigerant gas.

1. Description of the Prior Art

In a compressor having a drive plate such as a swingable swash plate, the drive plate is mounted on a rotatable shaft inside a crank chamber. The rotation of the shaft is converted to reciprocating movement of pistons in associated cylinder bores by the drive plate. The refrigerant gas, supplied to the cylinder bores from a suction chamber, is compressed by the reciprocating movement of the pistons and then discharged from the compressor via a discharge chamber. Since the crank chamber is defined in a tightly sealed space, it is necessary to maintain the pressure of the chamber within a proper range.

However, leakage, or blow-by of compressed gas occurs between the outer cylindrical surface of the pistons and the inner cylindrical surface of the respective cylinder bores. The blow-by enters the crank chamber and raises the pressure within. Furthermore, in a variable type compressor, which automatically adjusts an inclining angle of the drive plate, the discharge volume of the compressor is changed by automatically adjusting the pressure inside the crank chamber according to a cooling load. Accordingly, compressors having a structure which discharges the pressure within the crank chamber into other chambers have been proposed. These compressors communicate the crank chamber with the discharge chamber or suction chamber for releasing the pressure.

Japanese Examined Patent Publication 3-55675 discloses such a compressor. In this compressor, a gas bleeding passage is formed between the suction chamber and the crank chamber. Blow-by gas from the compressing chambers of the cylinder bores, is returned to the suction chamber via the passage. This prevents excessive pressurizing of the crank chamber caused by the blow-by gas.

In addition, an air intake passage, provided with a release valve, is formed between the discharge chamber and the crank chamber. The valve has a valve control mechanism on which the pressure of the crank chamber acts by way of a pressurizing passage. The opening and closing of the valve is controlled by the mechanism according to the pressure within the crank chamber. The opening and closing of the valve adjusts the pressure inside the crank chamber. This alters the inclining angle of the swing swash plate and controls the discharge volume of the compressed gas.

In the above compressor, a restricting section is normally provided in a gas bleeding passage to regulate the flow of refrigerant gas to a predetermined amount before the gas is returned to the suction chamber. As shown in FIG. 12, the restricting section comprises through holes 105, 106 and a passageway 108. The holes 105, 106 are respectively formed in a cylinder block 103 and valve plate 104. The passageway 108 is grooved in the inner end face of a rear housing 107 to communicate the through hole 106 with a suction chamber 100. The width and depth of the passageway 108 function to restrict the amount of fluid flow. The passageway 108 may be formed in the end face of the cylinder block 103 instead of the rear housing 107.

However, employing the passageway 108, formed in the rear housing 107 or cylinder block 103, to serve as the restricting section of the bleeding passage 102 leads to certain problems. Namely, the passageway 108 is formed during the molding of the rear housing 107 or cylinder block 103 in the end face. The end face of the housing 107 or cylinder block 103 is then ground to make it smooth. However, the depth of the grinding changes depending on the molding condition of the end face. Thus, inconsistent grinding depth of the end face alters the depth of the passageway 108. As a result, the size of the passageway differs in each compressor. Therefore, performance may vary slightly between products.

To solve this problem, the passageway 108 may be machined to a predetermined depth from the end face after the end face of the rear housing 107 or cylinder block 103 is ground. However, such machining operations are complicated and troublesome.

SUMMARY OF THE INVENTION

The object of the present invention is to provide a compressor having a pressure passage structure between chambers which results in consistent performance between each product and thereby allows stable operation.

A further object of the present invention is to provide a compressor having a pressure passage structure which may simply be formed.

To achieve the above objects, a first preferred embodiment discloses an improvement of the compressor having a cylinder block which has a front end surface and a rear end surface. A front housing is fixed to the front end surface, and a rear housing is fixed to the rear end surface by way of valve plates and a gasket to define a crank chamber, a suction chamber and a discharge chamber. The crank chamber accommodates a drive plate mounted on a drive shaft. The drive plate converts a rotation of the drive shaft into a reciprocating movement of a piston in the cylinder bore to compress gas supplied to the cylinder bore from the suction chamber. The improvement includes a first pressure passage which connects the suction chamber to the crank chamber. The first pressure passage is arranged to release pressure in the crank chamber to the suction chamber so as to regulate the pressure in the crank chamber. The first pressure passage is partially defined by a notch formed in the gasket. The notch is narrower than the rest of the first pressure passage to regulate said pressure to a predetermined value.

According to another preferred embodiment, the drive plate is tiltable with respect to an axis according to the pressure in the crank chamber. The tilting angle of drive plate controls the discharge volume of the compressor. A pressure transferring passage connects the crank chamber to the discharge chamber to transfer pressure in the discharge chamber to the crank chamber so as to adjust the pressure in the crank chamber. The pressure transferring passage is partially defined by a notch formed in the gasket. The notch is narrower than the rest of the pressure transferring passage in order to regulate said pressure to a predetermined value.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiments together with the accompanying drawings in which:

DETAILED DESCRIPTION OF THE PREFERRED EMBODIMENTS

A first embodiment of a variable reciprocating type compressor according to the present invention will now be described with reference to FIGS. 1 through 6.

Figure 1:
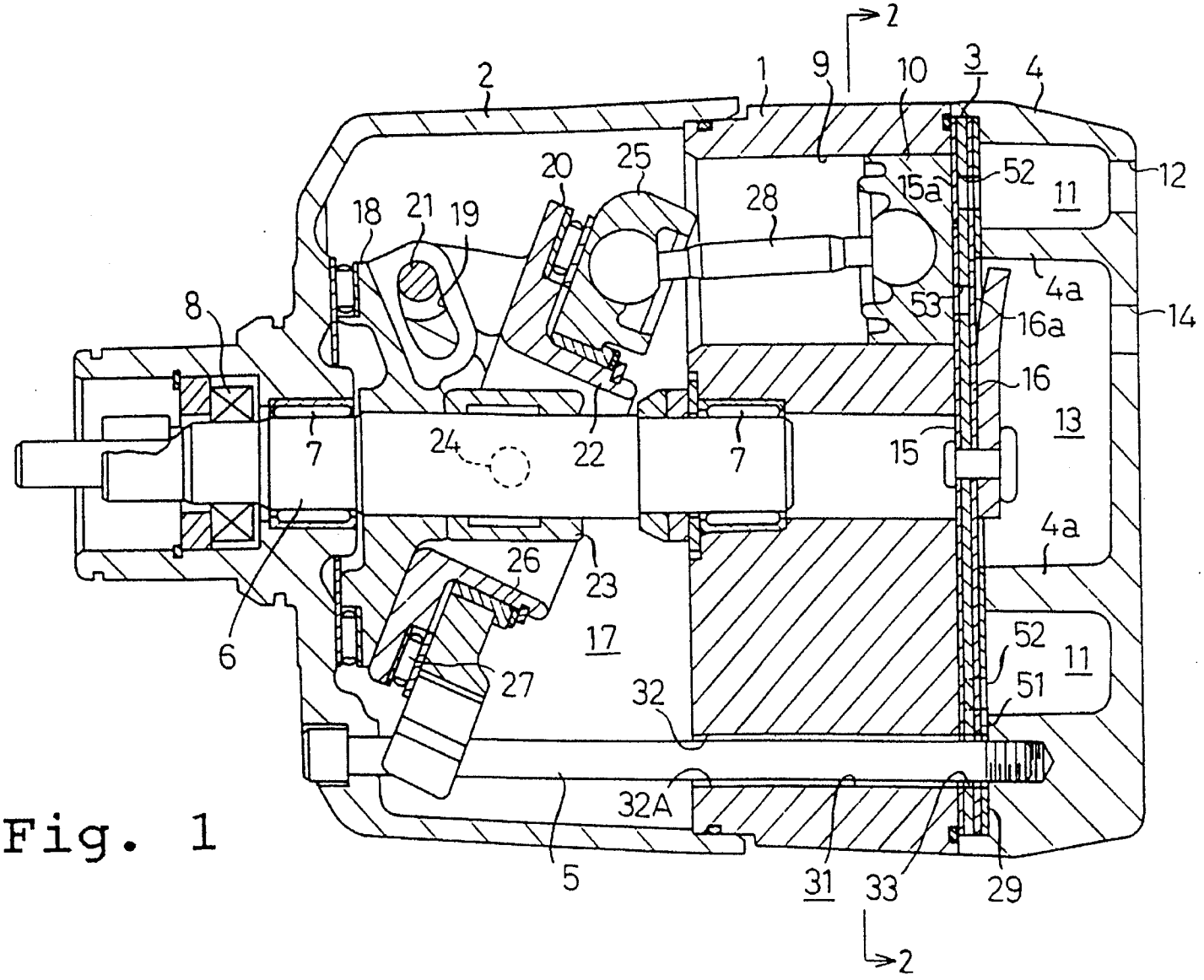
FIG. 1 is a cross-sectional side elevation view showing a first embodiment of a variable reciprocating type compressor according to the present invention.
Figure 2:
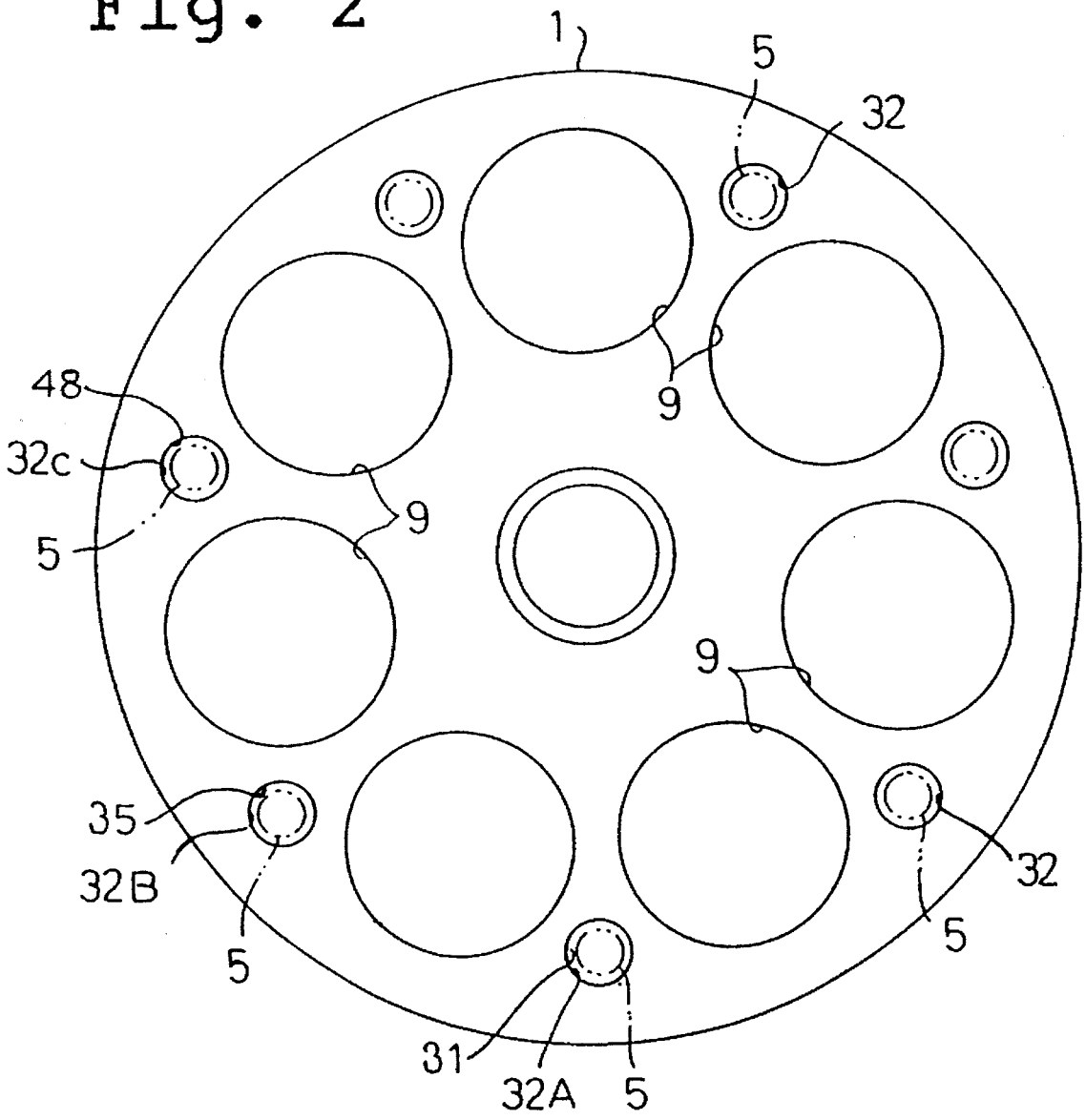
FIG. 2 is a side view as seen in the direction of the plane indicated by the line 2—2 of FIG. 1 with some parts omitted.

As shown in FIGS. 1 and 2, a front housing 2 is connected to a front end of a cylinder block 1. A rear housing 4 is connected to a rear end of the cylinder block 1 with a valve plate 3 located inbetween. Both housings 2, 4 and the cylinder block 1 are securely fastened together with a plurality of through bolts 5.

A drive shaft 6 is rotatably supported in the center of the cylinder block 1 and housing 2 by a pair of bearings 7 and a shaft seal apparatus 8. The shaft 6 is connected to and driven by a drive source (not shown) such as an engine. A plurality of cylinder bores 9 are formed in the cylinder block 1 from one end to the other. The bores 9 are arranged along the same circumference about the axis of the shaft 6 at equal intervals. A piston 10 is reciprocally received in each bore 9. The reciprocating movement of the piston 10 within the bore 9 defines a compression chamber having a variable volume.

An annular partition 4*a* is integrally formed in the rear housing 4. The partition 4*a* separates an annular suction chamber 11, defined on the outer circumferential side, from a discharge chamber 13, defined in the center portion. The suction and discharge chambers 11, 13 are connected to an external cooling circuit (not shown) via a respective suction and discharge port 12, 14. A gasket 29 is provided between the rear housing 4 and valve plate 3. The gasket 29 is made of a metal plate such as low carbon steel and has a layer of rubber, having a thickness of 20 to 30 microns, bonded thereon by heat. The gasket 29 securely seals the space between the inner end face of the rear housing 4 and the valve plate 3. This maintains the suction chamber 11 securely sealed from the discharge chamber 13. It also ensures that the suction chamber 11 is sealed from the atmosphere.

The valve plate 3 is provided with a suction plate 15 on its cylinder block 1 side and a discharge plate 16 on its rear housing 4 side. A plurality of suction ports 52, which communicate each cylinder bore 9 with the suction chamber 11, are formed in the valve plate 3 and gasket 29. A plurality of suction valves 15*a*, which open and close the associated suction ports 52, are formed integrally in the suction plate 15. A plurality of discharge ports 53, which communicate each cylinder bore 9 with the discharge chamber 13, are formed in the valve plate 3. A plurality of discharge valves 16*a*, which open and close the associated discharge ports 53, are formed integrally in the suction plate 16.

A crank chamber 17 is formed in the front housing 2 in front of the cylinder block 1. A rotor 18, accommodated in the crank chamber 17, is fitted on the shaft 6 and rotates integrally with the shaft 6. The rotor 18 has an arm portion on its peripheral portion with a slot 19 formed therein. A swing plate 20, supported by the slot 19 of the rotor 18 by a connecting pin 21, is swingable and rotates integrally with the rotor 18. A boss portion 22 is formed at the center of the plate 20. A sleeve 23, fitted on the shaft 6, is movable in the axial direction of the shaft 6. The sleeve 23 has a pair of pins 24, projecting from its outer circumferential surface, which engage with the boss portion 22 of the plate 20.

A journal bearing 26 and a thrust bearing 27 support a swingable swash plate 25 and allow relative rotation between the plate 25 and boss portion 22 of the plate 20. The bearings 26, 27 also enables integral swinging of the swash plate 25 with the swing plate 20. Engagement between a portion of the plate 25 and one of the bolts 5 restricts rotation of the plate 25. A piston rod 28 connects each piston 10 with the plate 25. Rotation of the shaft 6 swings the plate 25 and reciprocates the pistons 10 by way of the rods 28.

As shown in FIGS. 1, 2, 5, and 6, a gas bleeding passage 31 is formed between the suction chamber 11 and crank chamber 17. The passage 31 constantly communicates the suction chamber 11 with the crank chamber 17. A description of the passage 31 will be given below. A through hole 33 is formed in the valve plate 3 and gasket 29. A restricting passageway 51, which communicates the hole 33 with one of the suction ports 52, is formed by cutting a notch in the gasket 29. The main portion of the passage 31 is formed by a bolt inserting hole 32A. The hole 32A is among one of a plurality of bolt inserting holes 32 provided in the cylinder block 1 for the bolts 5. The hole 32A, formed having a diameter larger than the diameter of the bolt 5, allows the refrigerant gas to flow through the space defined between the walls of the hole 32A and the outer surface of the bolt 5.

Figure 5:
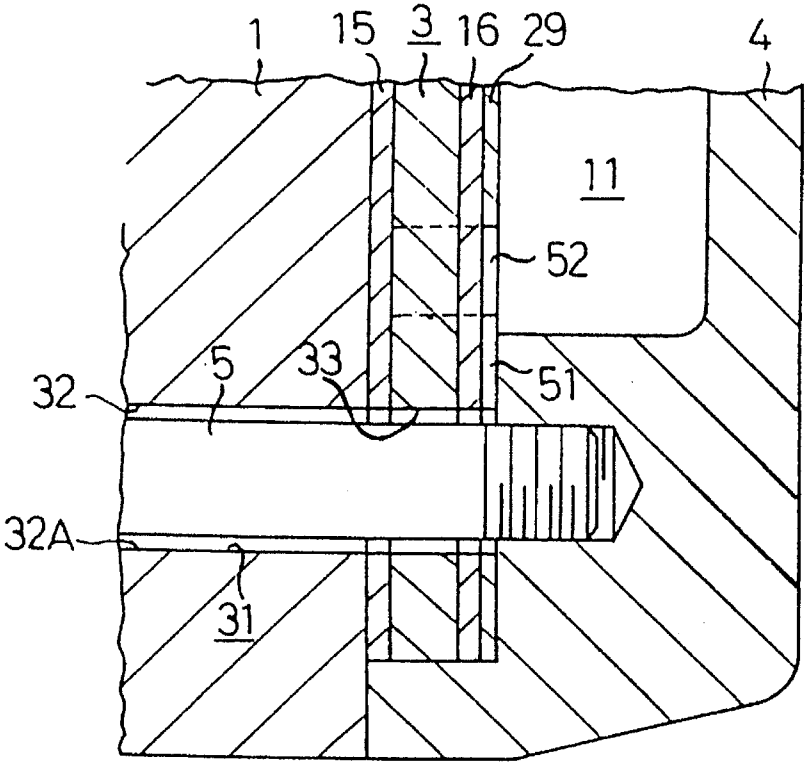
FIG. 5 is an enlarged partial cross-sectional view showing a gas bleeding passage between a suction chamber and crank chamber, and a restricting section provided in the bleeding passage.
Figure 6:
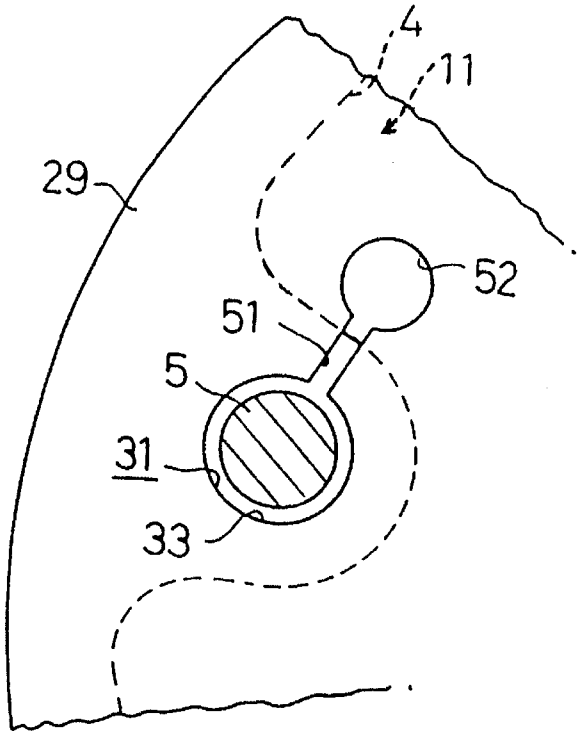
FIG. 6 is a partial cross-sectional view of the compressor of FIG. 5 showing the gas bleeding passage and restricting section in the gasket.

As shown in FIGS. 5 and 6, the restricting passageway 51 of the passage 31, extending between the through hole 33 and the associated suction port 52 for a predetermined length, serves as a restriction that regulates the flow of gas to a predetermined amount. Leakage, or blow-by of refrigerant gas from the cylinder chambers of the bores 9 in the crank chamber 17, is returned to the suction chamber 11 through the passage 31. The flow of the returning gas is regulated to a predetermined amount by the restricting passageway 51 in the passage 31 to reduce the pressure in the crank chamber 17. The cross-sectional area of the restricting passageway 51, adjusted by changing the width of the passageway 51 and the thickness of the gasket 29, regulates the flow of the refrigerant gas.

Figure 3:
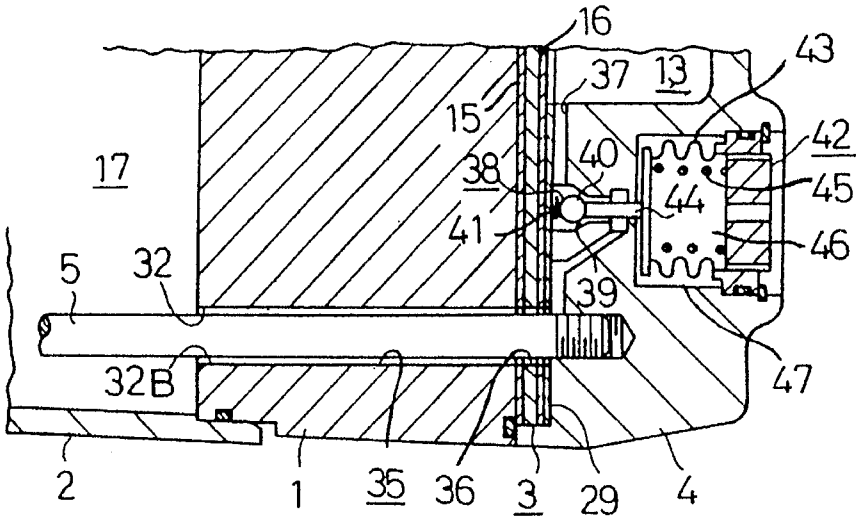
FIG. 3 is a partial cross-sectional view showing a gas intake passage between a discharge chamber and crank chamber, and a release valve for opening and closing of the intake passage.

As shown in FIGS. 2 and 3, a gas intake passage 35 is formed between the discharge chamber 13 and crank chamber 17. The passage 35 communicates the discharge chamber 13 with the crank chamber 17. The main portion of the passage 35 is formed by a bolt inserting hole 32B. The hole 32B is among one of the plurality of bolt inserting holes 32 provided in the cylinder block 1. The passage 35 also includes a through hole 36 formed in the valve plate 3 and gasket 29, and a passageway 37 formed substantially along the inner face end of the rear housing 4.

In other words, the hole 32B is formed having a diameter larger than the diameter of the bolt 5. The space defined between the inner wall of the hole 32B and the outer circumferential surface of the bolt 5 forms a portion of the passage 35.

A release valve 36 is provided in the passage 37 to open and close the intake passage 35. The valve 39 includes a valve seat 39 formed on a portion of the passage 37, a spherical tip 40 disposed facing the seat 39, and a spring 41 urging the spherical tip 40 towards the seat 39.

Figure 4:
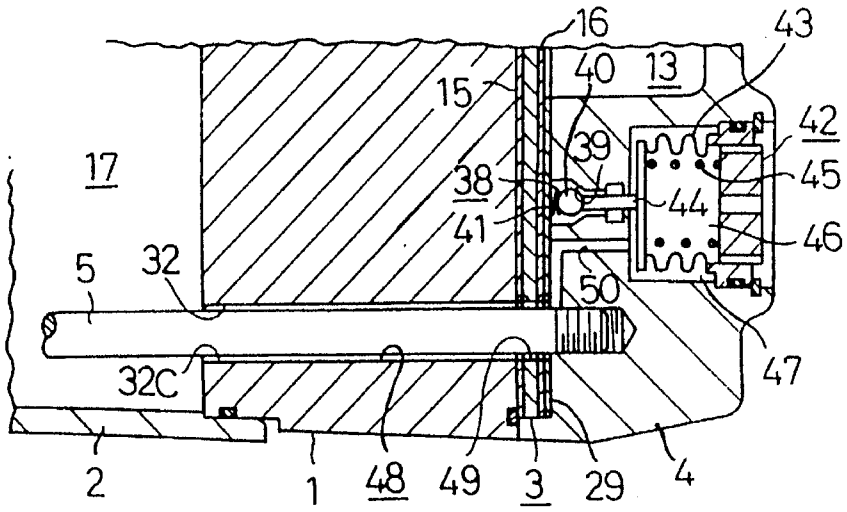
FIG. 4 is a partial cross-sectional view showing a valve control mechanism which controls the opening and closing of a release valve, and a passage through which the pressure of the crank chamber is regulated.

As shown in FIGS. 2 through 4, a valve control mechanism 42 is disposed next to the valve 38 to control the opening and closing of the valve 38. The valve control mechanism 42 comprises a bellows 43, an actuating rod 44 mounted between the bellows 43 and tip 40, and a spring 45 urging the bellows 43 and rod 44 towards the tip 40.

An atmospheric pressure chamber 46, communicating with the atmosphere, is defined inside the bellow. 43. A pressure detecting chamber 47 is defined outside the bellows 43. A pressurizing passage 48, which pressurizes the detecting chamber 47 to the pressure of the crank chamber 17, is formed between the crank chamber 17 and the detecting chamber 47. The main portion of the passage 48 is formed by a bolt inserting hole 32C. The hole 32C is among one of the plurality of bolt inserting holes 32 provided in the cylinder block 1. The passage 48 also includes a through hole 49 formed in the valve plate 3 and gasket 29, and a passageway 50 formed in the rear housing 4. In the same manner as with the gas bleeding passage 31 and gas intake passage 35, the hole 32C is formed having a diameter larger than the diameter of the bolt 5. The crank chamber 17 is communicated with the detecting chamber 47 by the space defined between the inner wall of the hole 32C and the outer circumferential surface of the bolt 5.

In this embodiment, a positioning structure (not shown) comprises a plurality of positioning holes and positioning pins provided between the cylinder block 1 and front housing 2, and between the cylinder block 1 and rear housing 4. Therefore, the housings 2, 4 are securely positioned with and fixed to each associated end of the cylinder block 1 regardless of the passages 31, 35, 48, defined in the inserting holes 32.

The operation of the variable reciprocating type compressor will now be described.

The pressure of the crank chamber 17 is maintained at a value higher than a designated value when the compressor is not in operation. Accordingly, the bellows 43 of the valve control mechanism 42, detecting the high pressure of the crank chamber 17, is in a contracted state. This contraction holds the spherical tip 40 of the release valve 38 at a position closing the intake passage 35.

As the drive shaft 6, driven by a drive source such as an engine, is rotated, reciprocal swinging of the swash plate 25 by way of the rotor 18 and the swing plate 20 causes the reciprocating movement of each piston 10 inside the respective bores 9. The reciprocation of the pistons 10 forces the refrigerant gas in the suction chamber 11 to be introduced into the compressor chambers of the bores 9 through the suction valve mechanism 15. It also forces the gas compressed by the compression chamber to be discharged out into the discharge chamber 13 through the discharge valve mechanism 16.

During the initial stage of the activation of the compressor, the pressure in the suction chamber 11 is high since the high temperature of a vehicle interior increases the cooling load. Therefore, the pressure in the crank chamber 17 is just slightly higher than the pressure of the suction chamber 11. This increases the inclining angle of the swash plate 25 and reciprocates each piston 10 at maximum stroke to discharge a maximum volume of compressed refrigerant gas.

In this state, the blow-by gas, which leaks from the compressor chamber of each cylinder bore 9 into the crank chamber 17, is returned to the suction chamber 11 from the crank chamber 17 by way of the gas bleeding passage 31. Thus, an increase in internal pressure of the chamber 17 is suppressed, and the compressor continues discharging a maximum volume of compressed gas.

As the operation of the compressor continues, the lowered temperature of the vehicle interior decreases the cooling load. This decreases the pressure of the suction chamber 11 and lowers the pressure of the crank chamber 17 to a value lower than a designated value. As a result, the bellows 43 of the valve control mechanism 42 is extended. As shown in FIGS. 3 and 4, the extension moves the spherical tip 40 of the valve 38 to a position which opens the gas intake passage 35. Accordingly, the refrigerant gas in the discharge chamber 13 enters the crank chamber 17 via the intake passage 35 and prevents the pressure of the chamber 17 from falling lower than a designated value. This results in a large pressure difference between the crank chamber 17 and the suction chamber 11. The pressure difference reduces the inclining angle of the swash plate 25 and thus makes the stroke of the piston 10 smaller. Consequently, the discharged volume of the refrigerant gas is reduced.

In the compressor of this embodiment, the restricting passageway 51 is formed by cutting a notch with a predetermined width in the gasket 29 to serve as a restriction in the gas bleeding passage 31. As a result, in comparison with the conventional compressor where the restricting section is formed in the end face of the rear housing 4 or cylinder block 1, grinding of the end faces after molding does not lead to a difference in the size of the restriction between products. Accordingly, the restriction, or passageway 51, is formed with precision and accurately regulates the amount of gas flow in the bleeding passage 31. In addition, the restriction, formed by the passageway 51 may be manufactured simply and precisely by punching the passageway 51 out of the gasket material.

Furthermore, in the compressor of this embodiment, the gas bleeding passage 31, gas intake passage 35, and pressurizing passage 48 are each defined within the respective bolt inserting hole 32A, 32B, 32C. Therefore, these passages 31, 35, 48 are formed in the cylinder block 1 by machining the inserting holes 32A, 32B, 32C with a diameter larger than bolt 5. As a result, the machining of long holes having a small diameter between each cylinder bore 9 using a drill having a long length and small diameter, as in the manufacture of conventional compressors, has become obsolete. Additionally, these passages 31, 35, 48 are not required to be formed separately from the holes 32. This enables simplification of the machining process and reduces the machining time of the cylinder block 1.

Furthermore, since the passages 31, 35, 48 are not required to be formed using exclusive space in the cylinder block 1, the cylinder block 1 may be made compact. This permits the production of a smaller compressor.

In this embodiment, at least one of the passages 31, 35, 48 may be formed in the bolt inserting holes 32.

Figure 7:
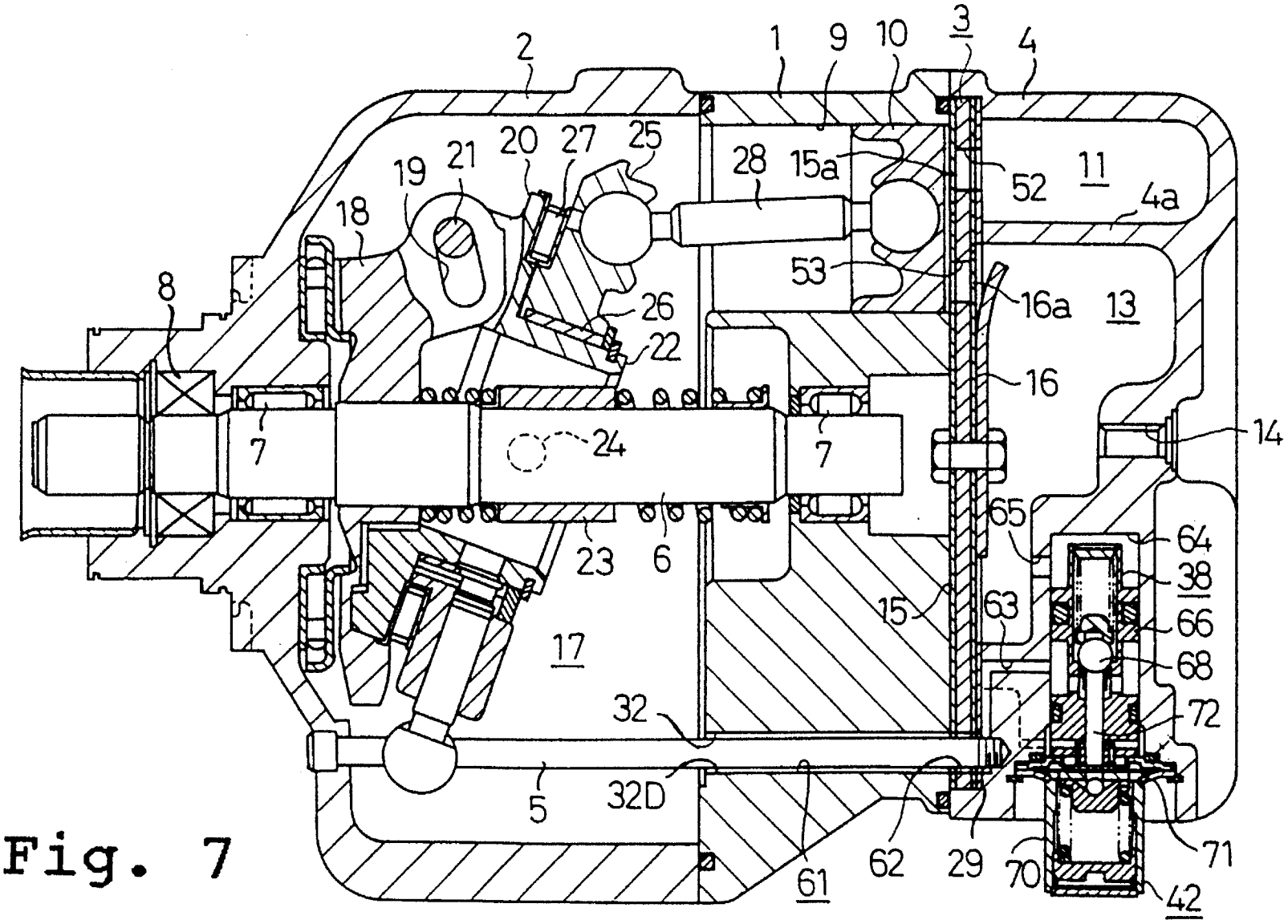
FIG. 7 is a cross-sectional side elevation view showing a second embodiment of a variable reciprocating type compressor according to the present invention.
Figure 8:
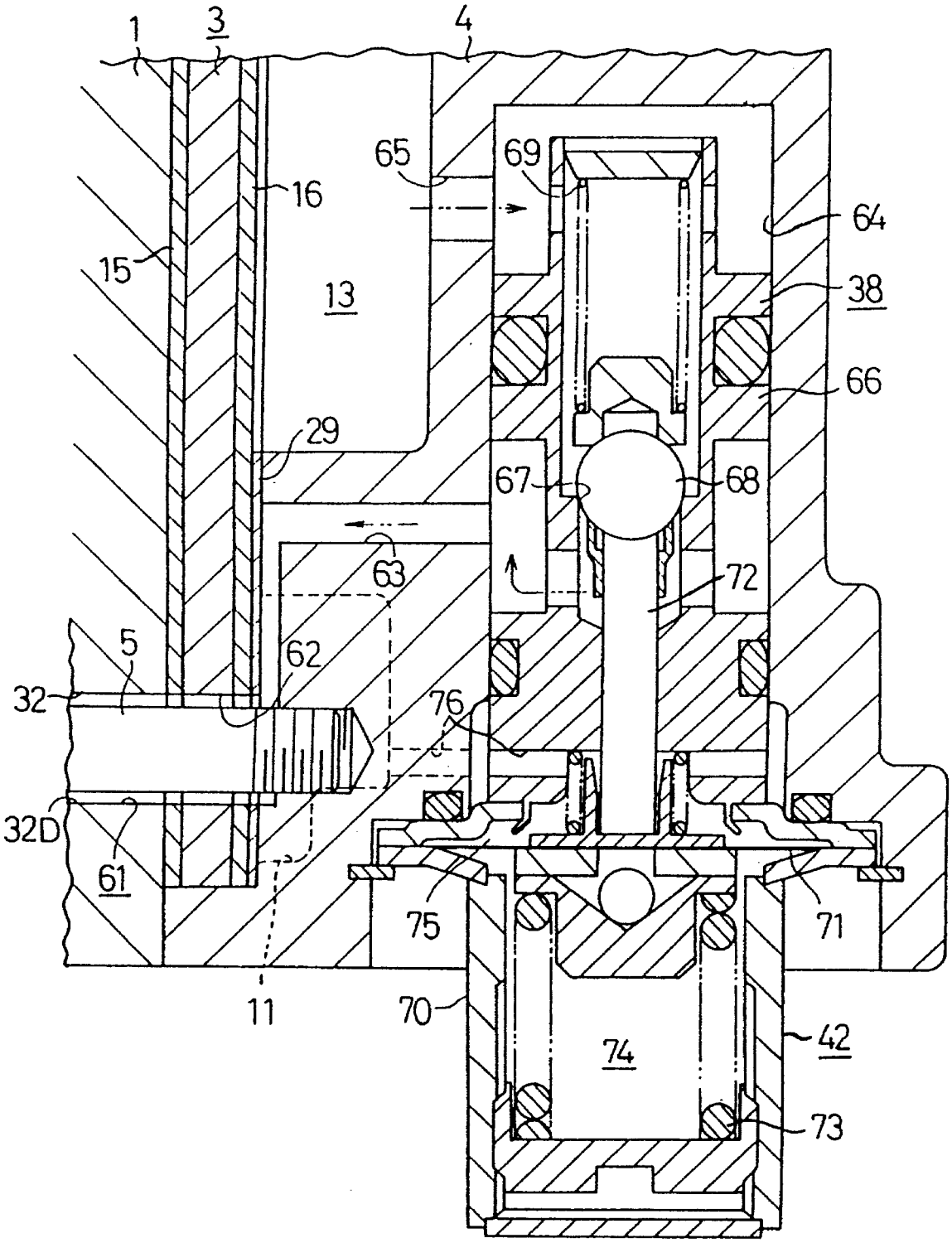
FIG. 8 is an enlarged partial cross-sectional view showing a gas intake passage between a discharge chamber and crank chamber, and a release valve for opening and closing of the intake passage.

A second embodiment of the variable reciprocating type compressor according to the present invention will now be described with reference to FIGS. 7 through 9.

In the same manner as with the first embodiment, a gas intake passage 61 communicating the discharge chamber 13 with the crank chamber 17 is formed between the chambers 13, 17. The main portion of the passage 61 is formed by a bolt inserting hole 32D provided in the cylinder block 1. The passage 61 includes a through hole 62 formed in the valve plate 3 and gasket 29, a passageway 63 formed in the rear housing 4, an accommodating hole 64 communicated with the passageway 63, and a passageway 65 connecting the hole 64 with the discharge chamber 13. The hole 32D is formed having a diameter larger than the diameter of the bolt 5.

A release valve 38 is provided in the passage 61. The valve includes a casing 66 accommodated within the hole 64, a valve seat 67 formed in the casing 66, a spherical tip 69 disposed facing the seat 67, and a spring 69 urging the tip 69 towards the seat 67.

A valve controlling mechanism 42, which controls the opening and closing of the valve 38, is disposed next to the valve 38. The mechanism 42 includes a constant pressure case 70, a diaphragm 71 stretched over the opening of the case 70, an actuating rod 72 mounted between the diaphragm 71 and the tip 69, and a spring 73 urging the tip 69 towards an open position through the diaphragm 71 and rod 72.

A constant pressure chamber 74 and a pressure detecting chamber 75 are formed in the case 70, partitioned from each other by the diaphragm 71. A pressurizing passage 76, formed in the rear housing 4 and casing 66, is provided between the suction chamber 11 and the detecting chamber 75. The detecting chamber 75 is pressurized to the suction pressure of the suction chamber 11 through the passage 76.

Figure 9:
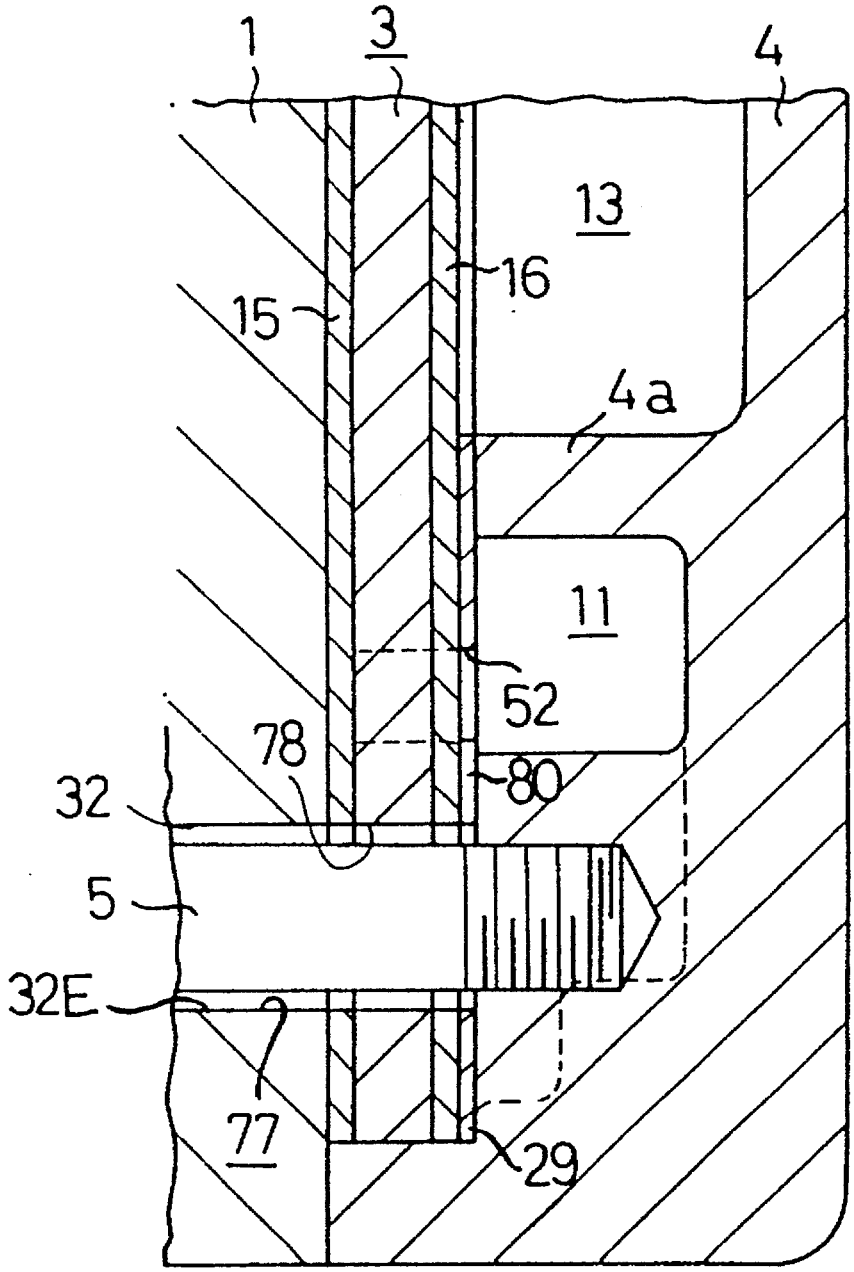
FIG. 9 is an enlarged partial cross-sectional view showing a gas bleeding passage between a suction chamber and crank chamber.

As shown in FIG. 9, a gas bleeding passage 77 communicating the suction chamber 11 with the crank chamber 17 is formed between the chambers 11, 17. The main portion of the passage 77 is formed by a bolt inserting hole 32E provided in the cylinder block 1. The passage 77 includes a through hole 79 formed in the valve plate 3 and gasket 29. The passage 77 also includes a restricting passageway 80, which has a predetermined width and communicates the through hole 78 with one of the suction ports 52. The restricting passageway 80 is formed by cutting a notch in the gasket 29. The passageway 80 in the passage 77 serves to restrict and thus regulate the flow of refrigerant gas to a predetermined amount.

In this embodiment, when the compressor is not in operation, the pressure of the suction chamber 11, discharge chamber 13, and crank chamber 17 are the same. This causes the tip 68 of the release valve 38 to abut against the valve seat 67, with the urging force of the springs 69, 73 in a balanced state, and close the passage 61.

When the operation of the compressor is commenced, rotation of the drive shaft 6 reciprocally swings the swash plate 25 and causes the reciprocating movement of each piston 10 inside the respective bores 9. The reciprocating movement of the pistons 10 forces the refrigerant gas to be introduced into the compression chambers, defined in the bores 9, from the suction chamber 11 and then discharges the compressed gas out to the discharge chamber 13.

During the initial stage of activation of the compressor, the pressure in the suction chamber 11 is high due to the high cooling load. A high suction pressure acts on pressure detecting chamber 75 of the valve controlling mechanism 42 by way of the pressurizing passage 76. Therefore, the tip 68 of the release valve 38 is maintained in a state in which the gas intake passage 61 is closed. This prevents the refrigerant gas in the discharge chamber 13 from entering the crank chamber 17. Furthermore, the blow-by gas in the crank chamber 17 from the compressing chambers of the cylinder bore 9 is returned to the suction chamber 11 via the gas bleeding passage 77. Accordingly, the pressure difference between the pressure of the crank chamber 17 and the suction pressure is small. This increases the inclination of the swash plate 25 to a maximum angle and thus results in the compressor discharging a maximum volume of compressed refrigerant gas.

As the operation of the compressor continues, the lowered temperature of the vehicle interior decreases the cooling load. This decreases the pressure of the suction chamber 11 and also lowers the pressure of the pressure detecting chamber 17 of the valve controlling mechanism 42. Hence, the tip 68 of the release valve 38 moves away from the valve seat 67 via the actuating rod 72 and opens the gas intake passage 61. Accordingly, the refrigerant gas in the discharge chamber 13 enters the crank chamber 17 via the intake passage 61 and increases the pressure difference between the crank chamber 17 and the suction pressure. This results in a large pressure difference between the crank chamber 17 and the suction chamber 11. The pressure difference reduces the inclining angle of the swash plate 25 and thus makes the stroke of the piston 10 smaller. Consequently, the discharged amount of compressed gas is reduced.

In the compressor of the second embodiment, the restricting passageway 80 is formed by cutting a notch with a predetermined width in the gasket 29 to serve as a restriction 80 in the gas bleeding passage 77. The restriction is not formed in the end face of the rear housing 4 or cylinder block 1. Therefore, as in the case with the first embodiment, the restricting passageway 80 is formed with precision and accurately regulates the amount of gas flow in the bleeding passage 77. In addition, the restricting passageway 80 may be formed simply and precisely with a predetermined size in the gasket 29.

In the compressor of the second embodiment, the passages 61, 77 are formed in the bolt inserting holes 32D, 32E provided in the cylinder block 1. As a result, machining with a drill having a long length and small diameter is not required. Therefore, the same benefits of the first embodiment, such as the easy formation of the passages 61, 77 in the cylinder block 1 within a short period of time, are also obtained in the compressor of the second embodiment.

In the second embodiment, both passages 61, 77 are formed in the bolt inserting holes 32. However, only one of the passages 61, 77 may be formed in any one hole 32.

Figure 10:
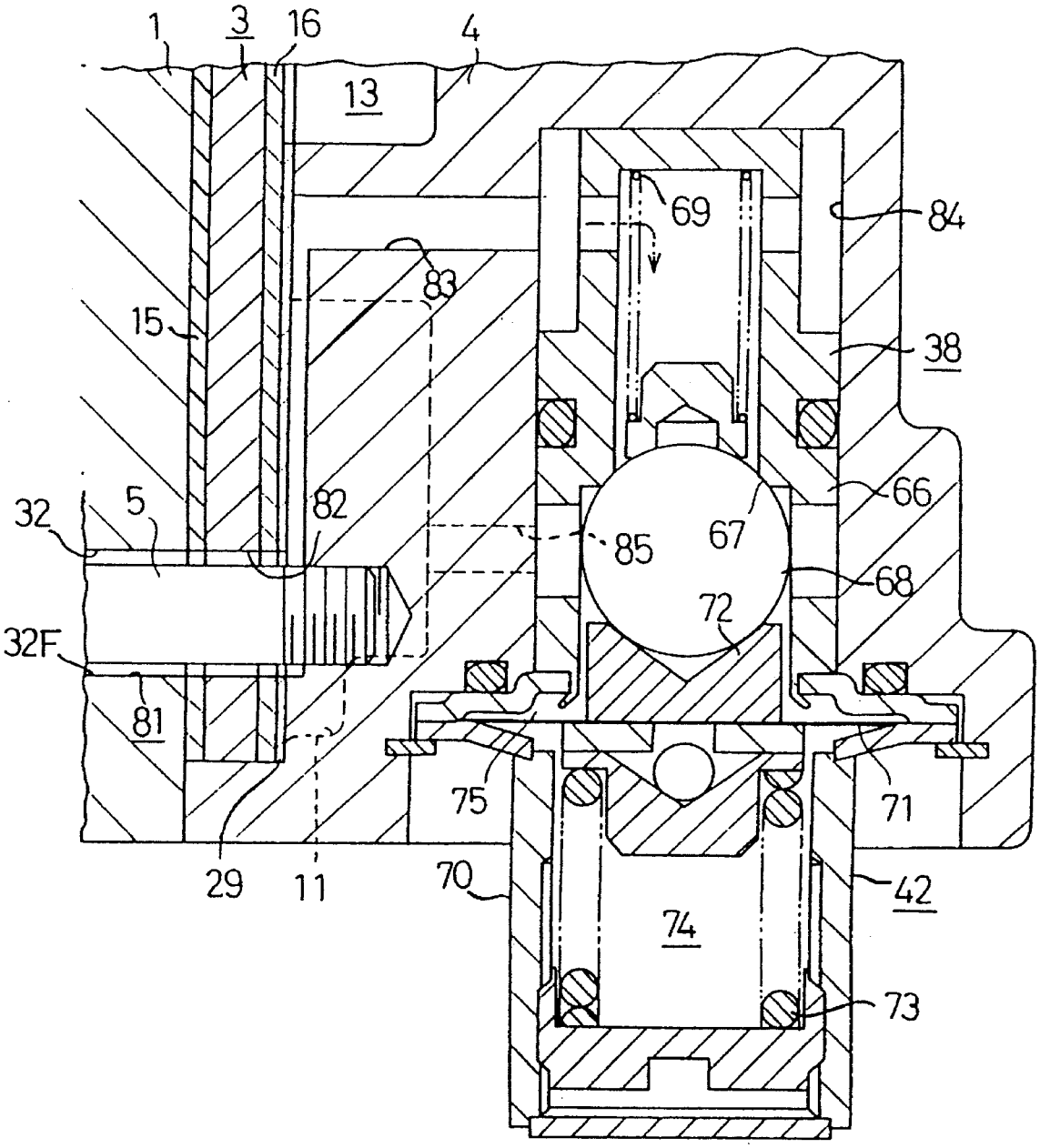
FIG. 10 is an enlarged partial cross-sectional view of a third embodiment of a variable reciprocating type compressor according to the present invention particularly showing a gas bleeding passage between a suction chamber and crank chamber, and a release valve for opening and closing of the bleeding passage.

A third embodiment of the present invention will be described with reference to FIGS. 10 and 11.

In this embodiment, a gas bleeding passage 81 communicates the suction chamber 11 with the crank chamber 17. The main portion of the passage 81 is formed by a bolt inserting hole 32F which is provided in the cylinder block 1. The passage 81 includes a through hole 82 formed in the valve 3, a passageway 83 formed in the rear housing 4, an accommodating hole 84 which communicates with the passageway 83, and a passageway 85 which connects the hole 84 with the suction chamber 11. The inserting hole 32F is formed having a diameter larger than the diameter of the bolt 5.

The release valve 38, for opening and closing of the passage 81, is provided in the accommodating hole 84 of the passage 81. As in the second embodiment, the valve 38 includes the casing 66, valve seat 67, spherical tip 68, and spring 69. However, the valve 38 is different from the second embodiment in the point that the spring 69 urges the tip 68 away from the seat 67.

A valve controlling mechanism 42, which controls the opening and closing of the valve 38, is disposed next to the valve 38. As in the second embodiment, the mechanism 42 includes the constant pressure case 70, diaphragm 71, actuating rod 72, and spring 73. However, the mechanism 42 is different from the second embodiment in the point that the tip 68 is urged toward the seat 67 by the spring 73. Furthermore, as in the second embodiment, the constant pressure chamber 74 and pressure detecting chamber 75 are formed in the case 70 partitioned from each other by the diaphragm 71. The detecting chamber 75 communicates with the suction chamber 11 via the passageway 85 of the bleeding passage 81.

Figure 11:
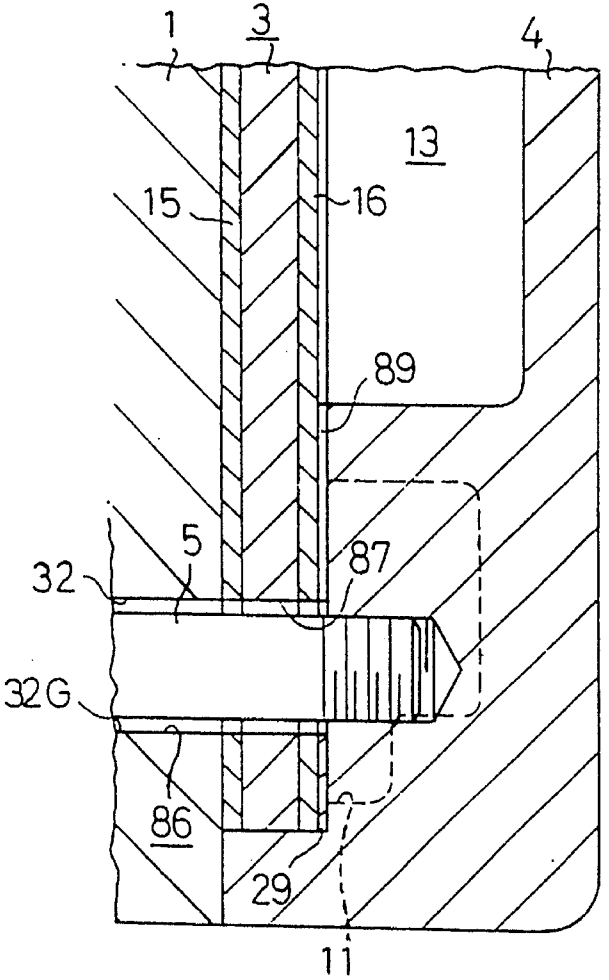
FIG. 11 is an enlarged partial cross-sectional view showing a gas intake passage between a discharge chamber and crank chamber, and a release valve for opening and closing of the intake passage.
Figure 12:
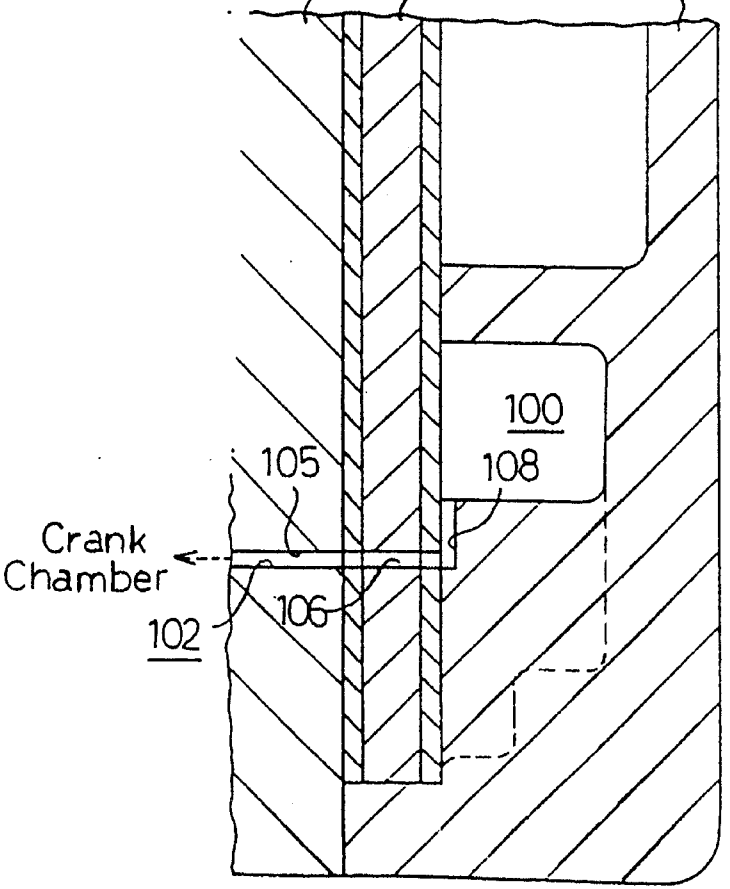
Fig. 12 Prior Art
FIG. 12 is an enlarged partial cross-sectional view showing a gas bleeding passage between a suction chamber and crank chamber in a prior art compressor.

As shown in FIG. 11, a gas intake passage 86 is formed between the discharge chamber 13 and crank chamber 17. The passage 86 communicates the discharge chamber 13 with the crank chamber 17. The main portion of the passage 86 is formed by a bolt inserting hole 32G provided in the cylinder block 1. The hole 32G is formed having a diameter larger than the diameter of the bolt 5. A through hole 87, communicated with the inserting hole 32G, is formed in the valve plate 3 and gasket 29. The through hole 87 is connected to the discharge chamber 13 by a restricting passageway 89. The restricting passageway 89 is formed by cutting a notch, having a predetermined width, in the gasket 29. The passageway 89 serves to regulate the flow of the refrigerant gas to a predetermined amount.

In the compressor of the third embodiment, high cooling load raises the pressure of the suction chamber 11 and thereby increases the pressure inside the detecting chamber 75. This moves the tip 68 of the release valve 36 to a position opening the bleeding passage 81. As a result, the refrigerant gas in the crank chamber 17, which is blow-by gas from the compressor chambers of the cylinder bores 9 or is supplied from the discharge chamber 13 via the gas intake passage 86, is released into the suction chamber 11. Accordingly, the small pressure difference between the pressure of the crank chamber 17 and the suction pressure causes the swash plate 25 to be inclined to a maximum angle thereby discharging a maximum volume of compressed refrigerant gas from the compressor.

As the cooling load decreases and lowers the pressure of the suction chamber 11, the pressure in the pressure detecting chamber 75 is also decreased. This causes the tip 68, urged by the spring 73, to close the bleeding passage 81. Therefore, the flow of the refrigerant gas, from the crank chamber 17 to the suction chamber 11 via the passage 81 is blocked. As a result, the blow-by gas from the compressor chambers of the cylinder bores 9 and the supply of refrigerant gas from the discharge chamber 13 via the gas intake passage 86 raises the pressure of the crank chamber 17. Accordingly, the difference between the pressure of the crank chamber 17 and the suction pressure makes the stroke of the pistons 10 smaller and reduces the discharge volume of the refrigerant gas.

In the compressor of the third embodiment, the restricting passageway 89 is also formed by cutting a notch with a predetermined width in the gasket 29 to serve as a restriction in the gas intake passage 86. The restriction is not formed in the end face of the rear housing 4 or cylinder block 1. Therefore, as in the case with the first and second embodiments, the restricting passageway 89 is formed with precision and accurately regulates the amount of gas flow in the gas intake passage 86. In addition, the restriction formed by the passageway 89 may be formed simply and precisely with a predetermined size in the gasket 29.

Furthermore, the passages 81, 86 are formed in the bolt inserting holes 32F, 32G provided in the cylinder block 1. As a result, a drill having a long length and small diameter is not required when machining the passages 81, 86 in the cylinder block 1. Therefore, the same benefits of the first and second embodiments, such as the easy formation of the passages 81, 86 in the cylinder block 1 within a short period of time, are also obtained in the compressor of this embodiment.

In the third embodiment, both passages 81, 86 are formed in the bolt inserting holes 32. However, alternatively, only one of the passages 81, 86 may be formed in the holes 32.

Although the present invention has been described in the embodiments herein, it should be apparent to those skilled in the art that the present invention may be embodied in many other specific forms without departing from the spirit or scope of the invention. For instance, the present invention may be embodied in a type of compressor which does not alter the inclining angle of the swash plate 25. In other words, the present invention may be embodied in a compressor which is not a variable type. In this case, the gas bleeding passage, which constantly communicates the suction chamber with the crank chamber, is formed with a gasket having a notch cut therein to regulate the flow of gas to a predetermined amount.

Therefore, the present examples and embodiments are to be considered as illustrative and not restrictive and the invention is not to be limited to the details given herein, but may be modified within the scope of the appended claims.

What is claimed is:

1. A compressor including a cylinder block which has a front end surface and a rear end surface, a front housing fixed to the front end surface, and a rear housing fixed to the rear end surface by way of valve plates and a gasket to define a crank chamber, a suction chamber and a discharge chamber, said crank chamber accommodating a drive plate mounted on a drive shaft, wherein said drive plate converts a rotation of the drive shaft into a reciprocating movement of a piston in the cylinder bore to compress gas supplied to the cylinder bore from the suction chamber and discharge the compressed gas to the discharge chamber, said compressor comprising:

a first pressure passage connecting the suction chamber to the crank chamber, said first pressure passage being arranged to release pressure in the crank chamber to the suction chamber so as to regulate the pressure in the crank chamber; and said first pressure passage being partially defined by a notch formed in said gasket, said notch being narrower than the rest of said first pressure passage to regulate said pressure.

2. The compressor as set forth in claim 1, wherein said first pressure passage regulates an excessive amount of the pressure in the crank chamber to the predetermined value and release the regulated pressure to the suction chamber, said excessive amount being based on the gas compressed by the piston in the cylinder bore and leaked therefrom to the crank chamber.

3. The compressor as set forth in claim 2, wherein said drive plate is tiltable with respect to an axis of said drive shaft according to the pressure in the crank chamber, and wherein the tilting angle of the drive plate controls the discharge volume of the compressor.

4. A compressor including a cylinder block which has a front end surface and a rear end surface, a front housing fixed to the front end surface, and a rear housing fixed to the rear end surface by way of a valve plate and a gasket to define a crank chamber, a suction chamber and a discharge chamber, said crank chamber accommodating a drive plate mounted on a drive shaft, wherein said drive plate converts a rotation of the drive shaft into a reciprocating movement of a piston in the cylinder bore to compress gas supplied to the cylinder bore from the suction chamber and discharge the compressed gas to the discharge chamber, said compressor comprising:

a first pressure passage connecting the suction chamber to the crank chamber, said first pressure passage being arranged to release pressure in the crank chamber to the suction chamber so as to regulate the pressure in the crank chamber;

said first pressure passage being partially defined by a notch formed in said gasket, wherein said notch is narrower than the rest of said first pressure passage to regulate said pressure;

said first pressure passage regulating the pressure in the crank chamber to a predetermined value by releasing excessive pressure to the suction chamber, the amount of released pressure being based on the gas compressed by the piston in the cylinder bore and leaked therefrom to the crank chamber;

said drive plate being tiltable with respect to an axis of said drive shaft according to the pressure in the crank chamber, and wherein the tilting angle of the drive plate controls the discharge volume of the compressor;

a second pressure passage connecting the crank chamber to the discharge chamber to transfer pressure from the discharge chamber to the crank chamber so as to adjust the pressure in the crank chamber; and a valve for selectively opening and closing the second pressure passage.

5. A compressor including a cylinder block which has a front end surface and a rear end surface, a front housing fixed to the front end surface, and a rear housing fixed to the rear end surface by way of valve plates and a gasket to define a crank chamber, a suction chamber and a discharge chamber, said crank chamber accommodating a drive plate mounted on a drive shaft, wherein said drive plate converts a rotation of the drive shaft into a reciprocating movement of a piston in the cylinder bore to compress gas supplied to the cylinder bore from the suction chamber and discharge the compressed gas to the discharge chamber, said compressor comprising:

said drive plate being tiltable with respect to an axis of said drive shaft according to the pressure in the crank chamber, and wherein a tilting angle of the drive plate controls a discharge volume of the compressor;

a pressure transferring passage connecting the crank chamber to the discharge chamber to transfer pressure in the discharge chamber to the crank chamber so as to adjust the pressure in the crank chamber; and said pressure transferring passage being partially defined by a notch formed in the gasket, said notch being narrower than the rest of the pressure transferring passage in order to regulate said pressure.

6. The compressor as set forth in claim 5, wherein said pressure transferring passage regulates the pressure transferred to the crank chamber from the discharge chamber and releases the regulated pressure to the suction chamber in accordance with the pressure decrease in the crank chamber.

7. The compressor as set forth in claim 6 further comprising:

a pressure releasing passage connecting the suction chamber to the crank chamber for releasing the pressure in the crank chamber to the suction chamber so as to regulate said pressure in the crank chamber; and a valve for selectively opening and closing the pressure releasing passage.

8. A compressor including a cylinder block which has a front end surface and a rear end surface, a front housing fixed to the front end surface, and a rear housing fixed to the rear end surface by way of a valve plate and a gasket to define a crank chamber, a suction chamber and a discharge chamber, said crank chamber accommodating a drive plate mounted on a drive shaft, wherein said drive plate converts a rotation of the drive shaft into a reciprocating movement of a piston in the cylinder bore to compress gas supplied to the cylinder bore from the suction chamber and discharge the compressed gas to the discharge chamber, said compressor comprising:

a first pressure passage connecting the suction chamber to the crank chamber, said first pressure passage being arranged to release excess pressure in the crank chamber to the suction chamber so as to regulate the pressure in the crank chamber to a predetermined value, the amount released being based on the gas compressed by the piston in the cylinder bore and leaked therefrom to the crank chamber, said first pressure passage being partially defined by a notch formed in said gasket, said notch being narrower than the rest of said first pressure passage to regulate said pressure;

said drive plate being tiltable with respect to an axis of said drive shaft according to the pressure in the crank chamber, and wherein the tilting angle of the drive plate controls the discharge volume of the compressor;

a second pressure passage connecting the crank chamber to the discharge chamber to transfer pressure from the discharge chamber to the crank chamber so as to adjust the pressure in the crank chamber; and a valve for selectively opening and closing said second pressure passage.

9. The compressor as set forth in claim 8 further comprising a pilot pressure passage for introducing one of the pressures in the crank chamber and suction chamber to selectively open and close said valve.

10. The compressor as set forth in claim 9, wherein said pilot pressure passage introduces the pressure of the suction chamber to the valve.

11. A compressor including a cylinder block which has a front end surface and a rear end surface, a front housing fixed to the front end surface, and a rear housing fixed to the rear end surface by way of valve plates and a gasket to define a crank chamber, a suction chamber and a discharge chamber, said crank chamber accommodating a drive plate mounted on a drive shaft, wherein said drive plate converts a rotation of the drive shaft into a reciprocating movement of a piston in the cylinder bore to compress gas supplied to the cylinder bore from the suction chamber and discharge the compressed gas to the discharge chamber, said compressor comprising:

a first pressure passage connecting the suction chamber to the crank chamber, said first pressure passage being arranged to release pressure in the crank chamber to the suction chamber so as to regulate the pressure in the crank chamber;

said first pressure passage being partially defined by a notch formed in said gasket, said notch being narrower than the rest of said first pressure passage to regulate said pressure; and a second pressure passage connecting the crank chamber to the discharge chamber to transfer pressure from the discharge chamber to the crank chamber so as to adjust the pressure in the crank chamber.

12. A compressor including a cylinder block which has a front end surface and a rear end surface, a front housing fixed to the front end surface, and a rear housing fixed to the rear end surface by way of valve plates and a gasket to define a crank chamber, a suction chamber and a discharge chamber, said crank chamber accommodating a drive plate mounted on a drive shaft, wherein said drive plate converts a rotation of a drive shaft into a reciprocating movement of a piston in the cylinder bore to compress gas supplied to the cylinder bore from the suction chamber and discharge the compressed gas to the discharge chamber, said compressor comprising:

a first pressure passage connecting the suction chamber to the crank chamber, said first pressure passage being arranged to release pressure in the crank chamber to the suction chamber so as to regulate the pressure in the crank chamber;

said first pressure passage comprising a gas bleeding passage defined in the cylinder block, a first hole defined in the gasket to communicate the bleeding passage with a second hole communicated with the suction chamber, and a slit connecting the first and second holes.

13. The compressor according to claim 12, wherein said first hole corresponds to a bolt inserting hole and wherein said second hole defines a suction port.

* * * * *

UNITED STATES PATENT AND TRADEMARK OFFICE

CERTIFICATE OF CORRECTION

PATENT NO. : 5,613,836

DATED : March 25, 1997

INVENTOR(S) : Takenaka et al

It is certified that error appears in the above-indentified patent and that said Letters Patent is hereby corrected as shown below:

Column 2, line 54, after "of" insert --the--.

Column 5, line 33, "36" should read --38--.

Column 7, line 42, "69" (both occurrences) should read --68--; line 50, "69" (both occurrences) should read --68--; line 65, "79" should read --78--.

Signed and Sealed this

Eighteenth Day of November 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,613,836
DATED : March 25, 1997
INVENTOR(S) : Kenji Takenaka, et. al.

It is certified that error appears in the above-identified patent and that said Letters Patent is hereby corrected as shown below:

Column 2, line 54, after "of " insert --the--.

Column 5, line 33, "36" should read --38--.

Column 7, line 42, "69" (both occurrences) should read--68--;
line 50, "69" (both occurrences) should read--68--;
line 65, "79" should read --78--.

Column 11, line 16, "release" should read --releases--.

Column 14, line 21, after "hole" insert --in the gasket--;
line 22, after "and a " delete "slit", insert --restricting passageway in the gasket--.

This certificate supersedes Certificate of Correction isssue November 18, 1997.

Signed and Sealed this

Thirtieth Day of December, 1997

*Attest:*

*Attesting Officer*

BRUCE LEHMAN

*Commissioner of Patents and Trademarks*